United States Patent [19]

Ogawa

[11] Patent Number: 4,514,155

[45] Date of Patent: Apr. 30, 1985

[54] ROTARY VANE PUMP WITH PACKING MEANS FOR THE HOUSING COMPONENTS

[75] Inventor: Hitoshi Ogawa, Himeji, Japan

[73] Assignee: Mitsubishi Denki Kabushiki Kaisha, Tokyo, Japan

[21] Appl. No.: 623,542

[22] Filed: Jun. 25, 1984

Related U.S. Application Data

[63] Continuation of Ser. No. 374,927, May 5, 1982, abandoned.

[30] Foreign Application Priority Data

May 11, 1981 [JP] Japan ..... 56-68099[U]
May 11, 1981 [JP] Japan ..... 56-68100[U]

[51] Int. Cl.[3] ..... F04C 27/00
[52] U.S. Cl. ..... 418/149
[58] Field of Search ..... 418/149

[56] References Cited

U.S. PATENT DOCUMENTS

| | | | |
|---|---|---|---|
| 628,989 | 7/1899 | Penn | 418/149 |
| 2,708,884 | 5/1955 | Deschamps | 418/149 X |
| 3,029,794 | 4/1962 | Rystrom | 418/149 X |

*Primary Examiner*—John J. Vrablik
*Assistant Examiner*—T. Olds
*Attorney, Agent, or Firm*—Oblon, Fisher, Spivak, McClelland & Maier

[57] ABSTRACT

A pump device connected to an AC generator for a car includes shoulder portions formed on both side surfaces of a plate or the side surface of an end frame and a housing, and chamfered portions or grooves formed in the end frame and the housing or the plate at positions corresponding to the shoulder portions. Packings are placed in spaces formed by the plate and the end frame and the housing.

2 Claims, 8 Drawing Figures

ROTARY VANE PUMP WITH PACKING MEANS FOR THE HOUSING COMPONENTS

This application is a continuation of application Ser. No. 374,927, filed May 5, 1982, now abandoned.

BACKGROUND OF THE INVENTION

1. Field of the Invention

The present invention relates to a rotary vane pump with packing means for the housing components.

2. Description of the Prior Art

FIG. 1 is a side cross sectional view of the conventional pump device and FIG. 2 is a front cross sectional view taken along the line II—II of FIG. 1. In the FIGS. 1 and 2, an end frame (1) is the bracket of an AC generator for a car (not shown). A shaft (2) is driven by the AC generator and is supported by the end frame through a bearing (3). A rotor (4) is fixed to the shaft (2) by a spline fitting. A plurality of vanes (5) are inserted into radial grooves of the rotor (4) so as to be slidable in the radial direction of the rotor (4). A housing (6) has a cylindrical inner wall which is eccentric to the center of the rotor (4) and contains the rotor (4) and the vanes (5). A plate (7) is placed between the end frame (1) and the housing (6). A fitting bolt (8) fastens the housing (6) and the plate (7) to the end frame (1). A packing (9) is used to seal the housing (6) and the plate (7) in a hermetic condition and a packing (10) is also used to seal the plate (7) and the end frame (1) in a hermetic condition. An oil seal (11) is fitted to the end frame (1) and is in contact with the circumference of the shaft (2) to keep the operation chamber of a pump device in a hermetic condition. An intake port (13), an exhaust port (14) and an oil feeding port (15) are formed in the housing (6) to be respectively connected to a vacuum tank, an oil pan and an oil pump (not shown).

The operation of the conventional pump device will be described. When the shaft (2) is rotated in the direction of the arrow mark in the FIG. 2, the vanes (5) are projected outwards by the centrifugal force given to the vanes and are rotated in sliding contact with the inner wall of the housing (6) whereby a vacuumed air in the vacuum tank is sucked from the intake port (13) and the air thus sucked is discharged through the exhaust port (14) to perform a pumping operation. Oil fed through the oil feeding port (15) into the housing (6) gives a lubrication for the sliding movement of the vanes (5) and the rotor (4) and is discharged into the oil pan (not shown) through the exhaust port (14).

In the conventional pump device, the packings (9) and (10) are respectively fitted to rectangular grooves in corss section formed on the side surface of the plate (7) and the housing (6) and are respectively clamped by the side surface of the adjacent end frame (1) and the housing (6). In a case that the packings (9), (10) are fitted to the grooves, however, the packings are often detached from the grooves because means for fixing the packing is not provided to result in low efficiency in assembling operation. When an O-ring packing is used, the inner diameter of the groove is normally formed smaller than that of the O-ring packing whereby the packing (9) or (10) easily rises from the groove. In this case, the packing (9) or (10) is fitted by a part associated with the groove to cause air leakage.

SUMMARY OF THE INVENTION

The present invention is to overcome these weaknesses of the conventional pump device and to provide a improved pump device in which shoulder portions are respectively formed on both side surfaces of a plate (7) or on the side surfaces of an end frame (1) and a housing (6) each facing the plate (7); chamfered portions are respectively formed on the end frame (1) and the housing (6) or on the plate (7) at a position corresponding to the shoulder portions; and packings (9) and (10) are clamped in spaces formed by the chamfered portions and the shoulder portions whereby an assembling operation of the packings (9), (10) is improved and the rise of the packings is prevented to eliminate fitting problem thereby increase reliability.

DETAILED DESCRIPTION OF THE PREFERRED EMBODIMENT

Several preferred embodiments of the present invention will be described.

Figure 1:
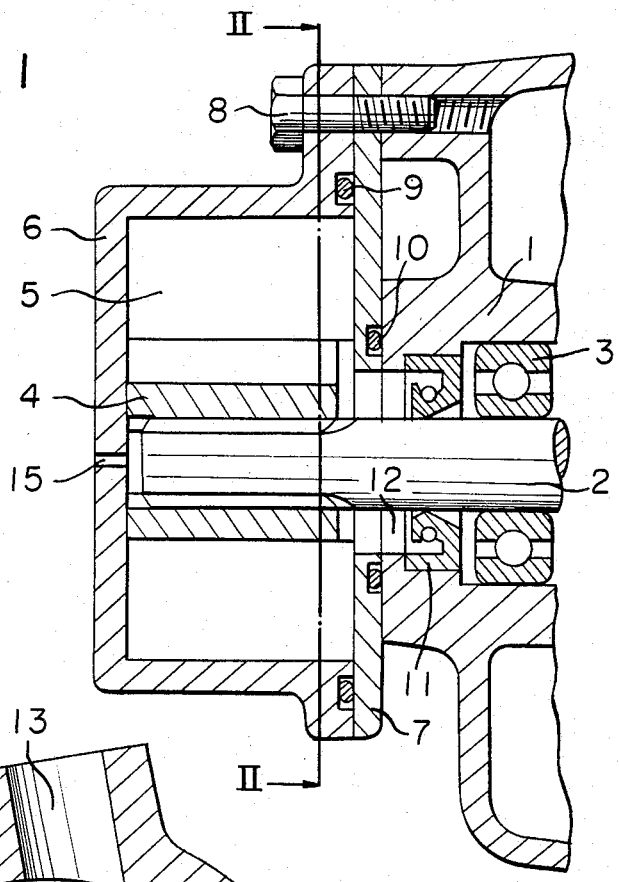
FIG. 1 PRIOR ART
FIG. 1 is a side cross sectional view of the conventional pump device.
Figure 2:
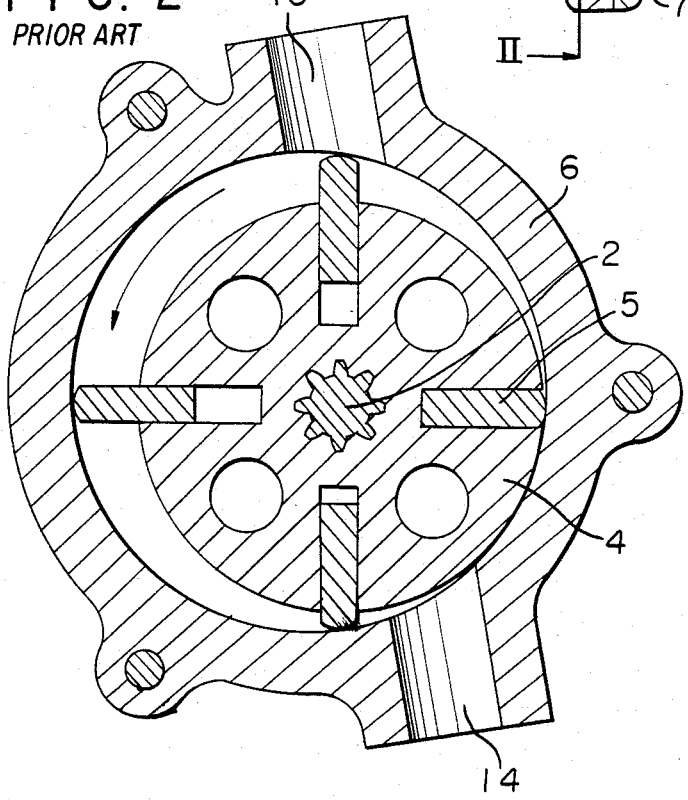
FIG. 2 PRIOR ART
FIG. 2 is a front cross sectional view taken along the line II—II of the FIG. 1.
Figure 3:
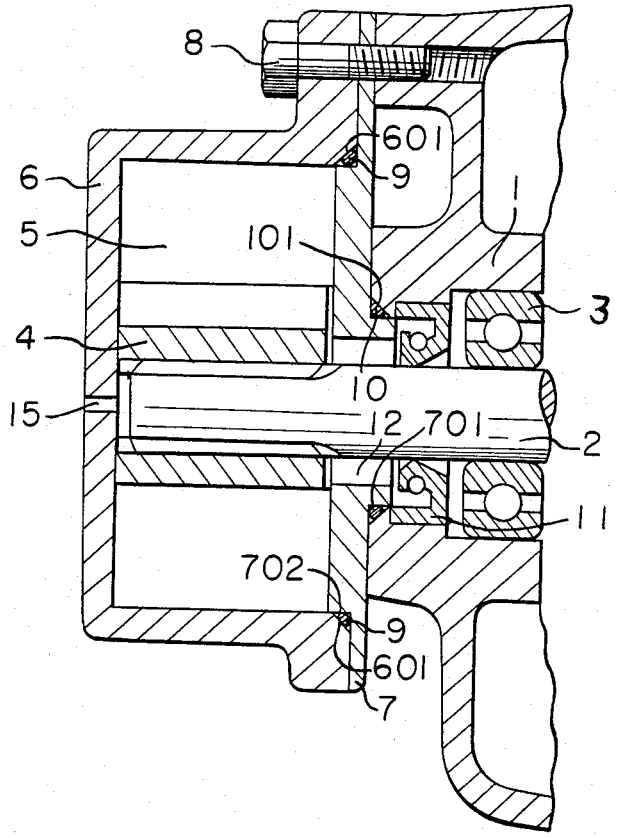
FIG. 3 is a side cross sectional view of a first embodiment of the pump device of the present invention.
Figure 4:
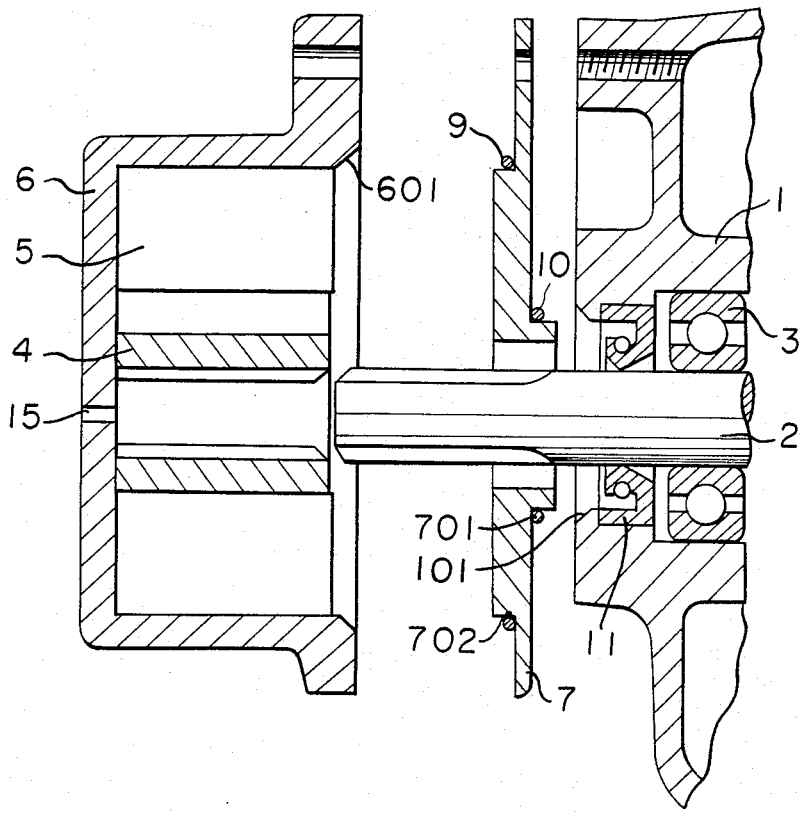
FIG. 4 is a cross sectional view showing a disassembled state of the FIG. 3.

The same reference numerals are given to the same or corresponding parts of the FIGS. 1 and 2. FIG. 3 is a side cross sectional view of the pump device of the present invention and FIG. 4 shows a disassembled state of the pump device in the FIG. 3. In the FIGS. 3 and 4, a chamfered portion (101) is formed in the end frame (1) and a chamfered portion (601) is formed in the housing (6). On the both side surfaces of the plate (7) in the axial direction, shoulder portions (701), (702) are respectively formed at positions corresponding to the chamfered portions (101), (601) and a packing (10) is held in a space formed by the chamfered portion (101) and the shoulder portion (701) and a packing (9) is held in a space formed by the chamfered portion (601) and the shoulder portions (702).

In the embodiment, fitting of the packings (9), (10) can be carried out by merely putting them at the shoulder portions (701), (702) formed on both the side surfaces of the plate (7). After the fitting of the packings (9), (10) to the plate (7), the plate (7) is assembled to the end frame (1) and then the housing (6) is assembled to the plate (7) whereby the packings (9), (10) can be clamped between them. The packings do not rise in the course of the assembling.

Figure 5:
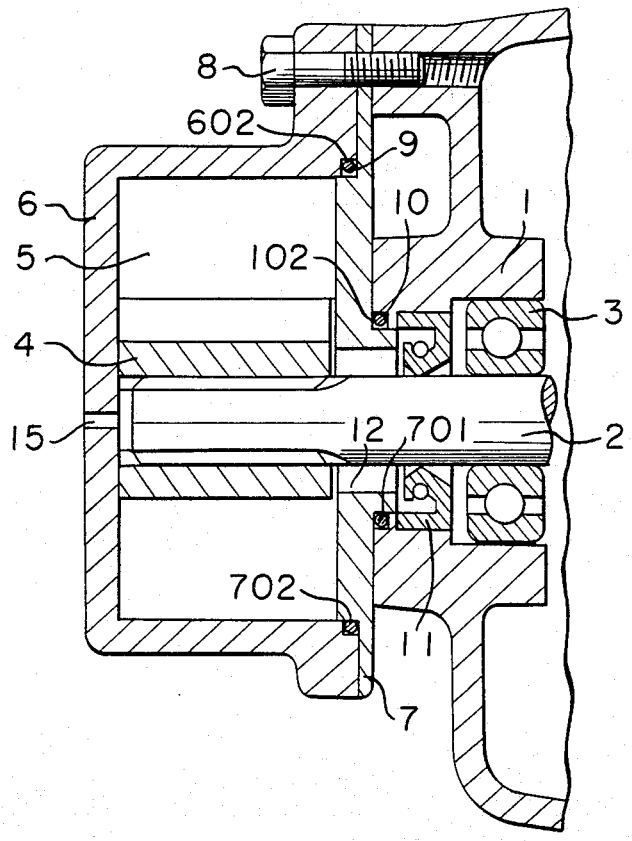
FIG. 5 is a side cross sectional view of a second embodiment of the present invention.

FIG. 5 is a side cross sectional view of the second embodiment of the pump device of the present invention. In the FIG. 5, a groove (102) is formed in the end frame (1) instead of forming the chamfered portion (101) and a groove (602) is formed in the housing (6)

instead of forming the chamfered portion (601) shown in FIG. 3. Thus, the same effect as the embodiment of FIG. 3 can be obtained by forming the grooves (102), (602) instead of the chamfered portions (101), (601).

Figure 6:
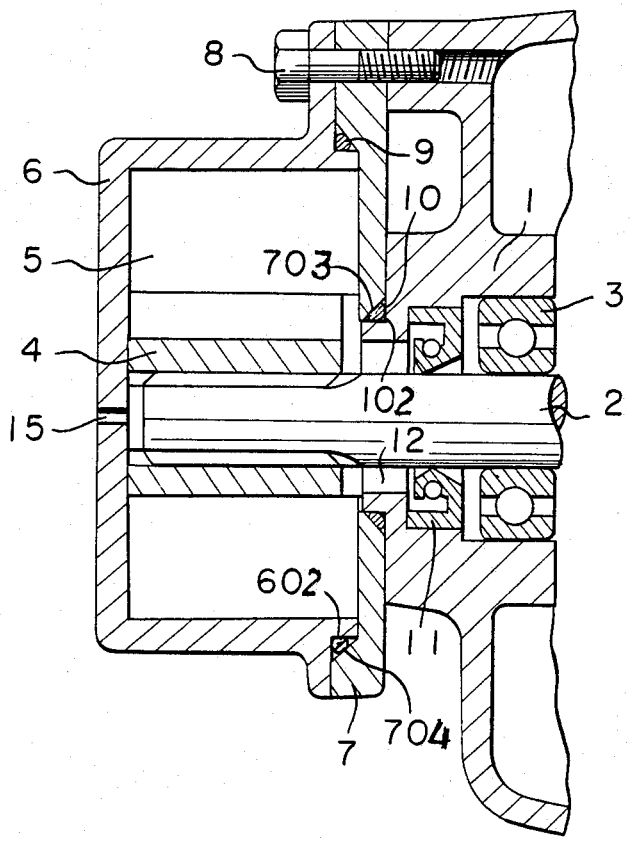
FIG. 6 is a side cross sectional view of a third embodiment of the present invention.

The third embodiment of the present invention will be described with reference to FIGS. 6 and 7. A shoulder portion (102) is formed in the end frame (1) and a shoulder portion (602) is formed in the housing (6). Chamfered portions (703), (704) are respectively formed in both the side surfaces of the plate (7) which respectively correspond to positions of the shoulder portions (102), (602). A packing (10) is held in a space formed by the shoulder portion (102) and the chamfered portion (703) and a packing (9) is held in a space formed by the shoulder portion (602) and the chamfered portion (704).

Figure 7:
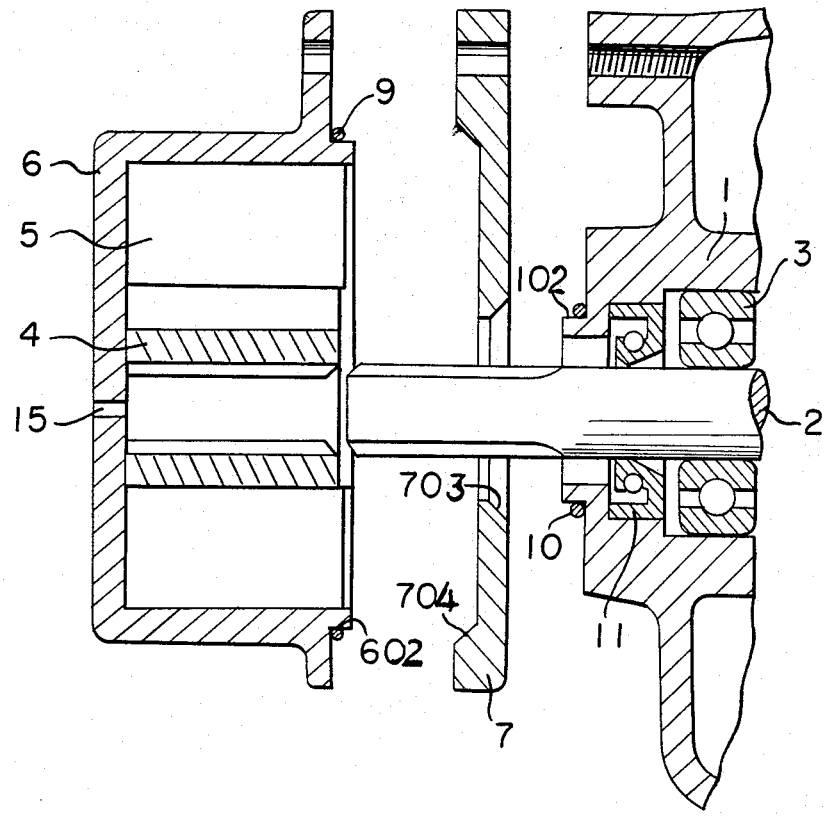
FIG. 7 is a cross sectional view showing a disassembled state of the FIG. 6.

In this embodiment, the packings (9), (10) can be easily fitted by assembling in accordance with the steps shown in FIG. 7 whereby rise of the packings (9), (10) can be prevented. The assembling is carried out by fitting the packing (10) to the shoulder portion (102) formed in the end frame (1), fitting the packing (9) to the shoulder portion (602) formed in the housing (6), attaching the plate (7) to the end frame (1) and attaching the housing (6) to the plate (7).

Figure 8:
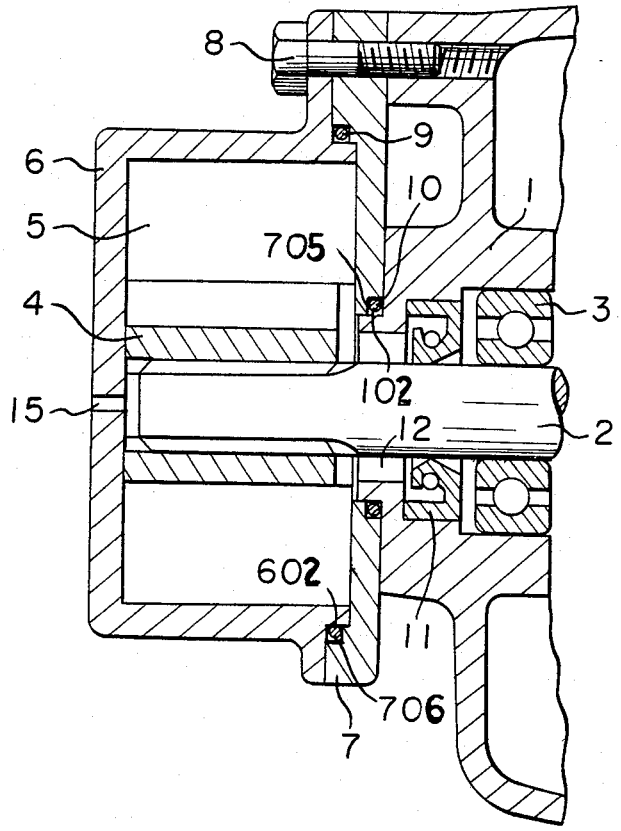
FIG. 8 is a side cross sectional view of a forth embodiment of the present invention.

FIG. 8 is a side cross sectional view of the fourth embodiment of the pump device. Grooves (705) and (706) are formed in the plate (7) instead of forming the chamfered portions (703), (704) in the FIG. 6. The same effect as the embodiment of the FIG. 6 can be obtained by forming the grooves (705), (706) instead of the grooves (703), (704).

As described above, in accordance with the present invention, shoulder portions are respectively formed on both side surfaces of a plate or the side surface of an end frame and a housing and chamfered portions or grooves are respectively formed in the end frame and the housing or the plate at positions corresponding to the shoulder portions. Packings are placed in each space formed by the plate and the end frame and the housing. With this structure, assembling operation including the fitting of the packings can be improved and the rise of the packings can be prevented thereby providing a reliable pump device.

I claim:

1. A pump device which comprises:

a housing comprising a cylindrical operation chamber, said operation chamber comprising a cylindrical inner wall, a substantially closed front end, and a rear opening having a diameter equal to that of said cylindrical inner wall, said rear opening being chamfered, said housing further comprising a flat rear face normal to the axis of said operation chamber and containing said rear opening of said operation chamber, said pump device further comprising an intake port and an exhaust port, both in communication with said operation chamber, a rotatable driving shaft, one end of which is disposed in said operation chamber, the axis of said driving shaft being parallel to and offset from said axis of said operation chamber, a rotor fixed to said driving shaft in said operation chamber, a plurality of radially-extending vanes disposed in said rotor, said vanes being in sliding contact with said cylindrical inner wall of said housing to forcibly feed a fluid from said intake port to said exhaust port, a plate fixed and fitted to said rear face of said housing and having a front face, a rear face and a cylindrical bore for the passage of said driving shaft, said front face of said plate further comprising a front flat land for snugly contacting said flat rear face of said housing, and a cylindrical front shoulder raised from said front flat land, said front shoulder of said plate extending into said operation chamber through said chamfered opening and mating with said cylindrical inner wall of said operation chamber, a first packing disposed around said front shoulder of said plate and being compressed between said front face of said plate and said chamfer of said rear opening of said operation chamber, said rear face of said plate comprising a rear flat land and a cylindrical rear shoulder raised from said rear flat land, said rear shoulder being concentric about said cylindrical bore for the passage of said driving shaft, an end frame comprising means for rotatably supporting said driving shaft, a flat front face, and a chamfered cylindrical passage, in which said driving shaft is disposed, opening into said flat front face of said end frame, said rear face of said plate being fixed and fitted to said front face of said end frame, said rear shoulder of said plate extending into said cylindrical passage in said end frame and mating with the cylindrical wall thereof, said rear flat land of said plate snugly contacting said flat front face of said end frame, and a second packing disposed around said rear shoulder of said plate and being compressed between said rear face of said plate and said chamfer of said cylindrical passage of said end frame, wherein said front shoulder of said plate and said rear shoulder of said plate respectively comprise means for establishing and maintaining proper positioning of said first and second packings during assembly of said pump device.

2. A pump device which comprises:

a housing comprising a cylindrical operation chamber, a cylindrical outer wall, a substantially closed front end, and a rear face, said operation chamber comprising a cylindrical inner wall, a substantially closed forward end formed by said front end of said housing, and a rear opening having a diameter equal to that of said cylindrical inner wall, said housing further comprising an annular ring formed about said cylindrical outer wall at a rear portion of said housing, said rear face of said housing being normal to the axis of said operation chamber and comprising a rear flat land formed on a rear face of said annular ring and an annular rear shoulder raised from said rear flat land, an intake port and an exhaust port, both in communication with said operation chamber, a rotatable driving shaft, one end of which is disposed in said operation chamber, the axis of said driving shaft being parallel to and offset from said axis of said operation chamber, a rotor fixed to said driving shaft in said operation chamber, a pluraity of radially-extending vanes disposed in said rotor, said vanes being in sliding contact with said cylindrical inner wall of said housing to forcibly feed a fluid from said intake port to said exhaust port, a plate fixed and fitted to said rear face of said housing and having a front face, a rear face, and a cylindrical bore for the passage of said driving shaft, said front face of said plate further comprising a front flat land for snugly contacting said rear flat land of said annular ring of said housing, an annular recessed front flat surface for contacting said rear shoulder of said housing to form a rear end of said operating chamber, said annular recessed front flat surface having a diameter substantially equal to an outer diameter of said rear shoulder of said housing, and a chamfer connecting said front flat land of said plate and said annular recessed front flat surface of said plate, said pump device further comprising a first packing disposed around said rear shoulder of said housing and being compressed between said rear flat land of said annular ring of said housing, said annular rear shoulder of said housing and said chamfer of front face of said plate, said rear face of said plate comprising a flat surface, said cylindrical bore in said plate for the passage of said driving shaft being chamfered at said rear face of said plate, an end frame comprising means for rotatably supporting said driving shaft, a flat front face, and an annular front shoulder raised from said flat front face concentrically about said driving shaft, said rear face of said plate being fixed and fitted to said front face of said end frame, said annular front shoulder of said end frame extending into said cylindrical bore for the passage of said driving shaft in said plate and mating with a cylindrical wall thereof, and a second packing disposed around said annular front shoulder of said end frame and being compressed by said front face of said end frame, by said front shoulder of said end frame, and by said chamfer of said bore of said plate, wherein said annular rear shoulder of said housing and said annular front shoulder of said end face respectively comprise means for establishing and maintaining proper positioning of said first and second packings during assembly of said pump device.

* * * * *